US007583175B2

(12) United States Patent
Yu

(10) Patent No.: US 7,583,175 B2
(45) Date of Patent: Sep. 1, 2009

(54) SAFETY SWITCH

(76) Inventor: Tsung Mou Yu, No. 4, Alley 2, Lane 23, Sec. 3, Pa Te Road, Panchiao, Taipei Hsien (TW)

( * ) Notice: Subject to any disclaimer, the term of this patent is extended or adjusted under 35 U.S.C. 154(b) by 185 days.

(21) Appl. No.: 11/941,841

(22) Filed: Nov. 16, 2007

(65) Prior Publication Data

US 2009/0127087 A1 May 21, 2009

(51) Int. Cl.
*H01H 71/16* (2006.01)
*H01H 71/58* (2006.01)

(52) U.S. Cl. ..... 337/59; 337/62; 337/66; 337/72

(58) Field of Classification Search ..... 337/62, 337/59, 66, 72; 200/553, 339, 341
See application file for complete search history.

(56) References Cited

U.S. PATENT DOCUMENTS 3,106,621 A * 10/1963 Bruno ..... 200/461
4,167,720 A 9/1979 Krasser
4,258,349 A * 3/1981 Flory ..... 337/46
4,937,548 A 6/1990 Sdunek
5,223,813 A 6/1993 Cambreleng et al.
5,262,748 A 11/1993 Tsung-Mou
5,451,729 A 9/1995 Onderka et al.
5,491,460 A * 2/1996 Krasser et al. ..... 337/70
5,539,371 A * 7/1996 Yu ..... 337/66
5,558,211 A 9/1996 Heydner et al.
5,828,284 A * 10/1998 Huang ..... 337/37
5,982,269 A * 11/1999 Sorenson ..... 337/380
6,072,381 A * 6/2000 Yu ..... 337/37
6,094,126 A * 7/2000 Sorenson ..... 337/37
6,252,490 B1 * 6/2001 Lin ..... 337/79
6,275,133 B1 * 8/2001 Chen ..... 337/37
6,275,134 B1 * 8/2001 Chen ..... 337/37
6,307,459 B1 * 10/2001 Yu ..... 337/37
6,400,250 B1 * 6/2002 Wang ..... 337/66
6,452,125 B1 * 9/2002 Yu ..... 200/553
6,469,610 B1 * 10/2002 Chen ..... 337/66
6,483,416 B2 * 11/2002 Yu ..... 337/126
6,525,639 B1 * 2/2003 Cheng ..... 337/37
6,538,553 B2 * 3/2003 Yu ..... 337/365
6,864,453 B1 * 3/2005 Yu ..... 200/520

(Continued)

FOREIGN PATENT DOCUMENTS

CH 647094 A * 12/1984

*Primary Examiner*—Anatoly Vortman
(74) *Attorney, Agent, or Firm*—WPAT, P.C.; Anthony King

(57) ABSTRACT

A switch includes a body with a switch member on a top thereof, an extension extends from an underside of the switch member, and a substantially inverted L-shaped slot is defined through the extension. Two terminals extend through a bottom of the body, in which one of the terminals is fixed with a contact plate. The contact plate has a tongue with a free end, which contacts the other terminal when the circuit is ON, and is separated from the other terminal when the circuit is OFF. An operation member has a first end movably engaged with the slot and a second end connected with the contact plate. A positioning member having a first end pivotally connected to an inside of the body and a second end biasing the first end of the operation member. Under the current overload condition, the switch member is pivoted by a torsion spring to the OFF position.

6 Claims, 6 Drawing Sheets

U.S. PATENT DOCUMENTS

| | | | | |
|---|---|---|---|---|
| 6,884,955 | B1 * | 4/2005 | Yu | 200/553 |
| 6,940,389 | B1 * | 9/2005 | Yu | 337/66 |
| 7,005,957 | B2 * | 2/2006 | Yu | 337/66 |
| 7,026,906 | B2 * | 4/2006 | Huang | 337/59 |
| 7,202,769 | B2 * | 4/2007 | Yu | 337/66 |
| 7,283,031 | B2 * | 10/2007 | Huang | 337/66 |
| 7,307,506 | B2 * | 12/2007 | Yu | 337/94 |
| 2003/0011461 | A1 * | 1/2003 | Yu | 337/89 |
| 2003/0071710 | A1 * | 4/2003 | Yu | 337/66 |
| 2003/0137390 | A1 * | 7/2003 | Huang | 337/37 |
| 2005/0264392 | A1 * | 12/2005 | Yu | 337/66 |
| 2007/0001798 | A1 * | 1/2007 | Yu | 337/66 |

* cited by examiner

SAFETY SWITCH

BACKGROUND OF THE INVENTION

1. Field of the Invention

The present invention relates to a safety switch that ensures the switch member to be pivoted automatically to "OFF" position under the current overload condition and the switch can be installed in any desired angle.

2. The Prior Arts

Each of U.S. Pat. Nos. 5,262,748, 4,167,720, 4,937,548, 5,223,813, 5,451,729 and 5,558,211 disclosed a safety switch and each of these safety switches uses a bi-metallic plate to prevent from being burn under the current overload condition. The bi-metallic plate is deformed when an overloading occurs so as to separate the two contact points respectively located on the bi-metallic plate and one of the two terminals. Some inherent shortcomings for these conventional safety switches are found. There are too many parts involved in the safety switch and a longer period of time is required when assembling the switch, this increases the cost of the product. The parts might be arranged inaccurately and affect the deformation of the bi-metallic plate. Once the bi-metallic plate is deformed to cut off the circuit, because of the improper arrangement of the parts as mentioned above, the bi-metallic plate could deform to re-connect the two contact points to connect the circuit again when the temperature of the bi-metallic plate is reduced. The re-connect action might generate sparks which could cause dangerous events.

Therefore, it is desired to have a safety switch that allows the switch member to be switched to OFF position after the bi-metallic plate is deformed to cut off the circuit. The safety switch also can be installed at desired angle which does not affect the operation of the safety switch.

SUMMARY OF THE INVENTION

In accordance with an aspect of the present invention, there is provided a switch that comprises a body with a switch member pivotally engaged with the top opening of the body. A first terminal and a second terminal extend through a bottom of the body. An extension extends from an underside of a first end of the switch member, and a slot is defined through the extension. A positioning member has a first end pivotally connected to an inside of the body. An operation member has a first end movably engaged with the slot of the extension, and a second end of the positioning member biases the first end of the operation member toward the first end of the switch member. A contact plate is a bi-metallic plate and has a first end thereof connected to a second end of the operation member and a second end fixed to the first terminal. An opening is defined through the contact plate, and a tongue has a first end connected to an inside of the opening. A second end of the tongue is a free end and has a contact point which is removably in contact with the other contact point on the second terminal. The first end of the contact plate and the second end of the tongue are deformed in opposite direction under the current overload condition.

The main objective of the present invention is to provide a switch which provides a sufficient space for movement of the operation member to ensure the contact plate to be deformed completely to cut off the circuit.

Another objective of the present invention is to provide a switch, which can be installed in any desired angle by using the positioning member.

Yet another objective of the present invention is to provide a switch, in which the switch member is automatically pivoted to "OFF" position under the current overload condition.

Yet another objective of the present invention is to provide a switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
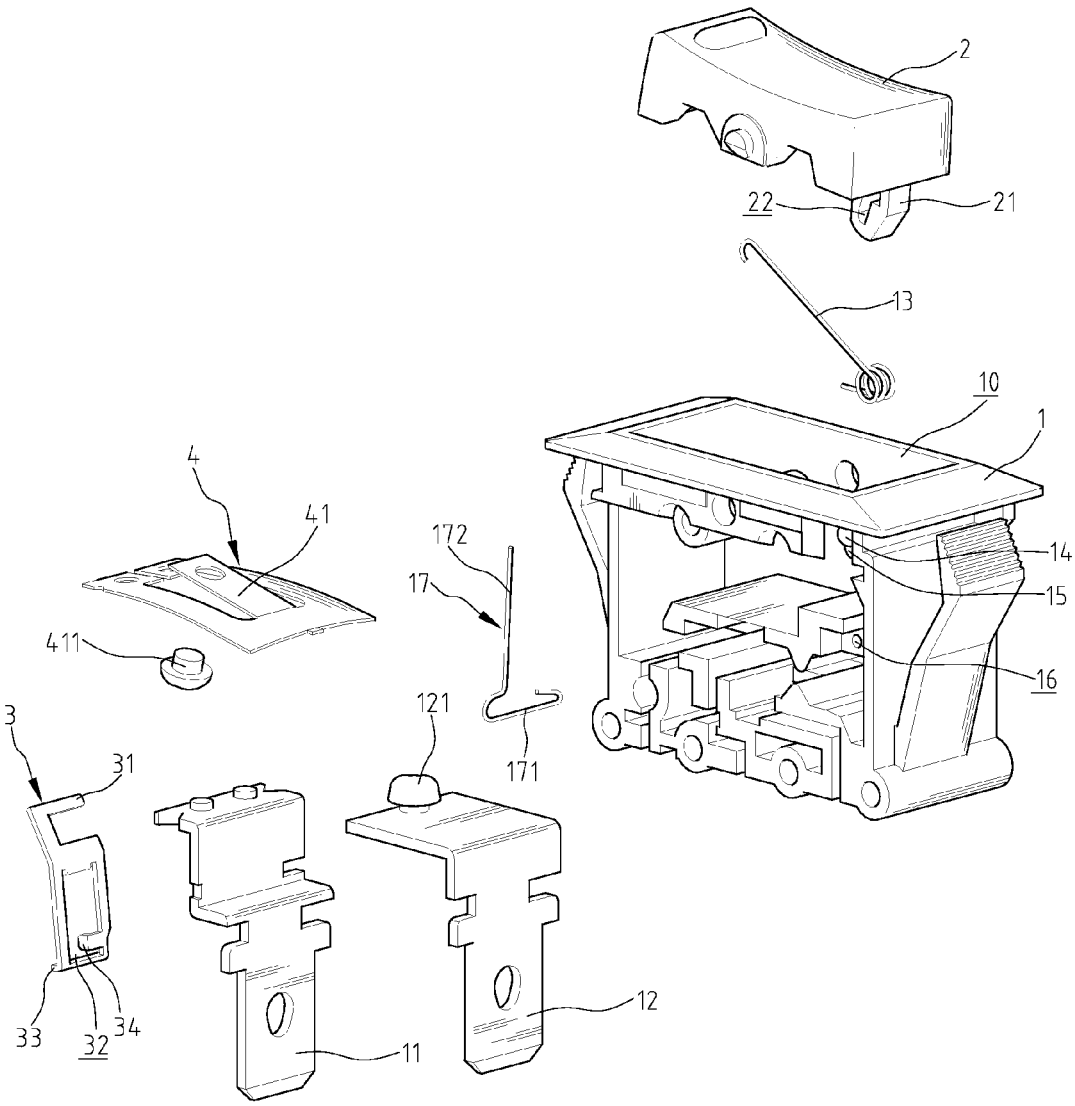
FIG. 1 is an exploded view to show a switch in accordance with the present invention.
Figure 2:
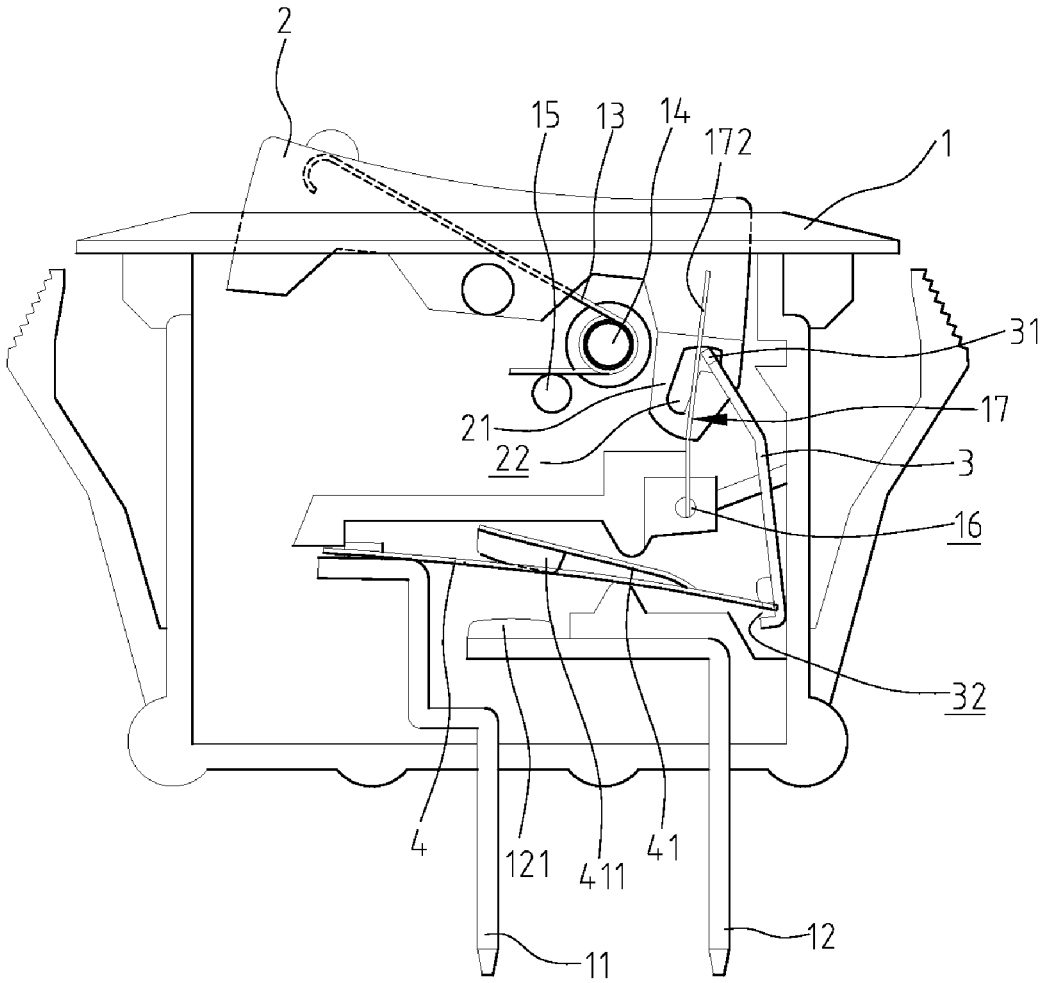
FIG. 2 is a side view to show the "OFF" status of the switch in accordance with the present invention.

Referring to the drawings and in particular to FIGS. 1 and 2, a switch in accordance with the present invention comprises a body 1 with a top opening 10, and a switch member 2 pivotally engaged with the top opening 10 of the body 1. An extension 21 extends from an underside of a first end of the switch member 2, and a substantially inverted L-shaped slot 22 is defined through the extension 21. The slot 22 includes a horizontal space and a vertical space. The switch member 2 is pivoted about the pivots on two sides of the mediate portion thereof. A torsion spring 13 is connected to the inside of the body 1, and includes a coil portion and two legs extended from the coil portion. The coil portion is mounted to a first rod 14 extending from the inside of the body 1 and one of the two legs is biased against a second rod 15 extending from the inside of the body 1. The other one of the two legs contacts the underside of a second end of the switch member 2. By the torsion spring 13, the switch member 2 is kept to be at its OFF position where the first end of the switch member 2 is located at lower position and the second end is located at higher position as shown in FIG. 2.

A first terminal 11 and a second terminal 12 extend through a bottom of the body 1, and a first contact point 121 is connected to a top bent portion of the second terminal 12. A positioning member 17 is made by resilient material and includes a first end pivotally connected to an inside of the body 1. The positioning member 17 is a substantially L-shaped member, which includes a horizontal portion 171 at the first end of the positioning member 17 and a vertical portion 172 connected to an end of the horizontal portion 171. A hook is defined in a distal end of the horizontal portion 171 which extends through a through hole 16 in the body 1 and the hook is hooked with the through hole 16.

Figure 3:
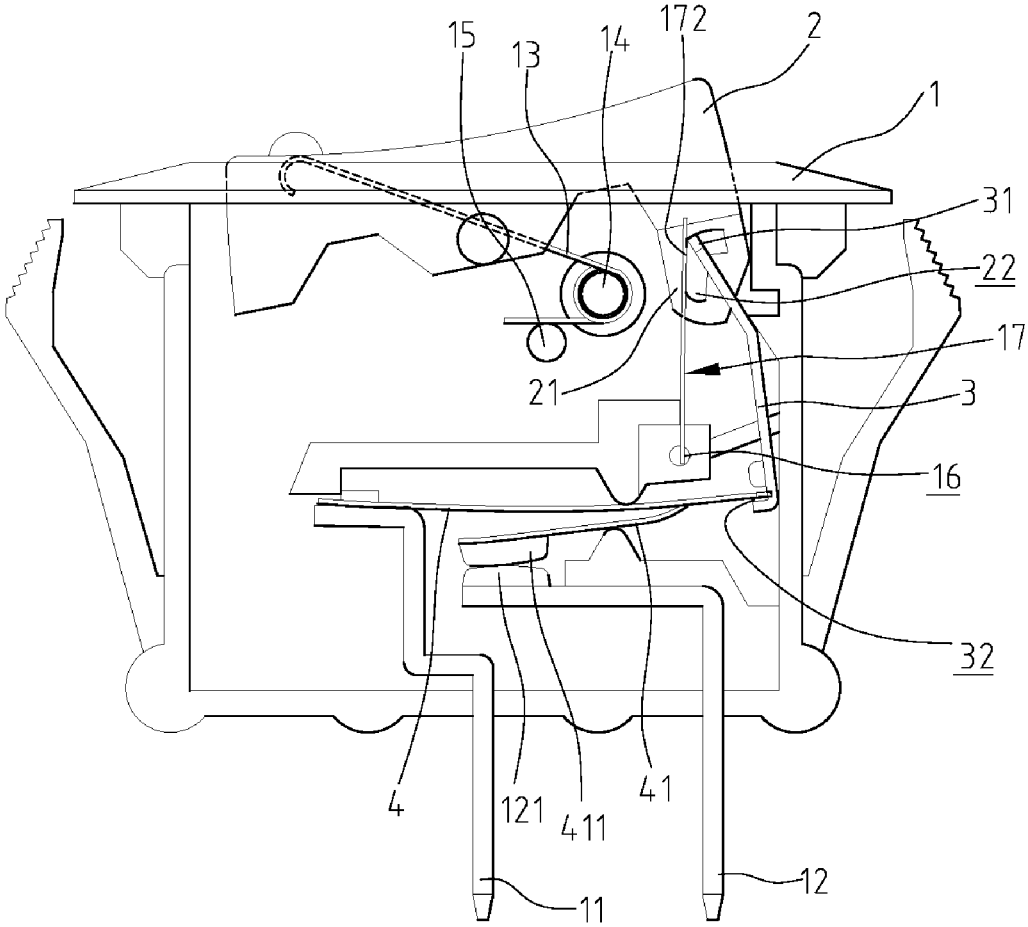
FIG. 3 is a side view to show the "ON" status of the switch in accordance with the present invention.

An operation member 3 has a first end movably engaged with the slot 22 of the extension 21 and a second end of the positioning member 17 biases the first end of the operation member 3 toward the first end of the switch member 2. In this embodiment, a horizontal rod 31 is connected to the first end of the operation member 3 and movably engaged with the horizontal space of the slot 22 between the OFF position as shown in FIG. 2 and the ON position as shown in FIG. 3. A hole is defined through the operation member 3 and a stub 34 extends from an inside of the hole. A lip 33 extends transversely from the second end of the operation member 3. An engaging space 32 is defined between the stub 34 and the lip 32. The width of the engaging space 32 is slightly larger than the thickness of the contact plate 4.

A contact plate 4 is made by bi-metallic material and has a first end thereof engaged with the engaging space in the second end of the operation member 3 and a second end of the contact plate 4 is fixed to the top bent portion of the first terminal 11. An opening is defined through the contact plate 4, a tongue 41 has a first end connected to an inside of the opening, and a second end of the tongue 41 is a free end. A second contact point 411 is fixed to the underside of the free end of the tongue 41 for being disengagably in contact with the first contact point 121 on the second terminal 12 when the circuit is cut off. The first end of the contact plate 4 and the second end of the tongue 41 are deformed in opposite direction under the current overload condition.

Figure 4:
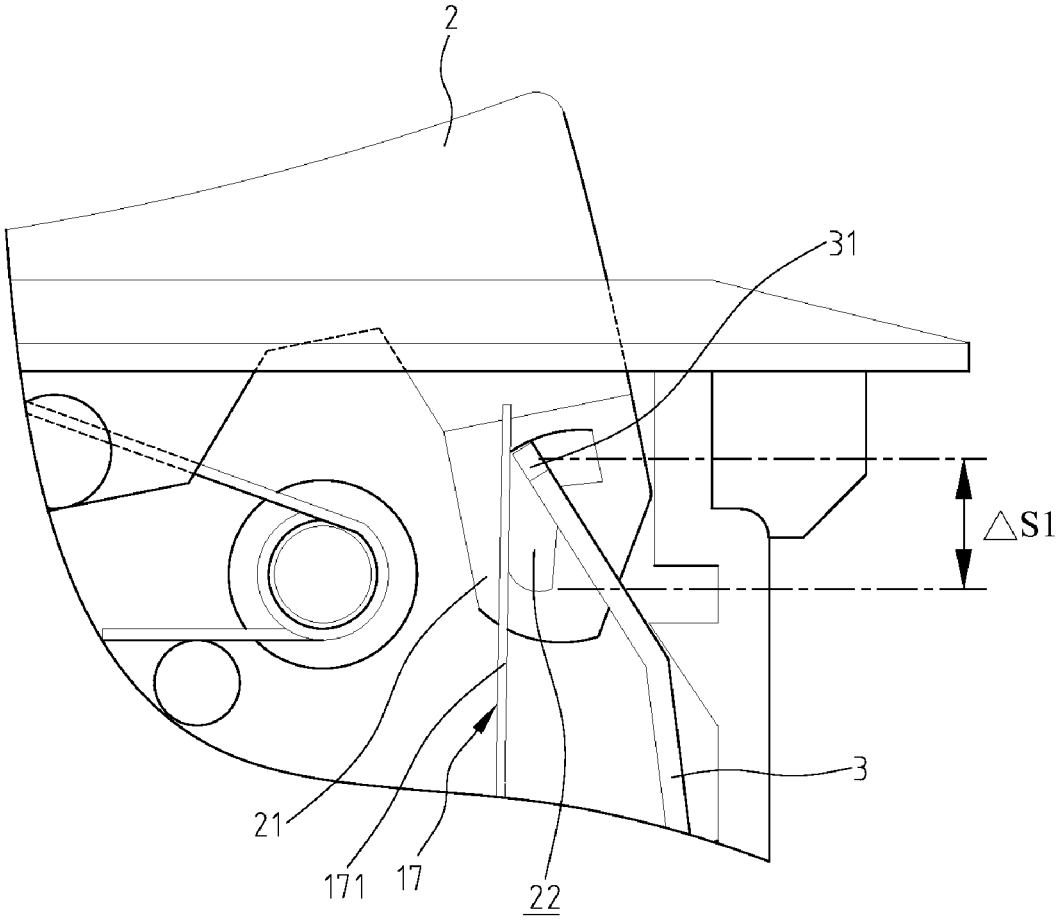
FIG. 4 is an enlarged view to show that a distance ΔS1 is provided for the movement of the first end of the operation member in the slot.

As shown in FIG. 2, when the first end is pushed downward, the operation member 3 is pushed downward so as to move the first end of the contact plate 4. The free end of the tongue 41 is then bent upward to separate the first contact point 121 and second contact point 411 to cut off the circuit. In the OFF position, the horizontal rod 31 of the first end of the operation member 3 is located at the right inner end of the horizontal space of the slot 22. As shown in FIG. 3, when pushing the second end of the switch member 2 downward, the first end of the contact plate 4 is lofted along with the movement of the operation member 3, the free end of the tongue 41 is then bent downward to let the first contact point 121 and second contact point 411 be in contact with each other to connect the circuit. In the ON position, the horizontal rod 31 of the first end of the operation member 3 is located at the left inner end of the horizontal space of the slot 22. As shown in FIG. 4, when the switch member 2 is in ON position, there is a distance $\Delta S1$ provided for the movement of the first end of the operation member in the slot 22 if an overloading occurs.

Figure 5:
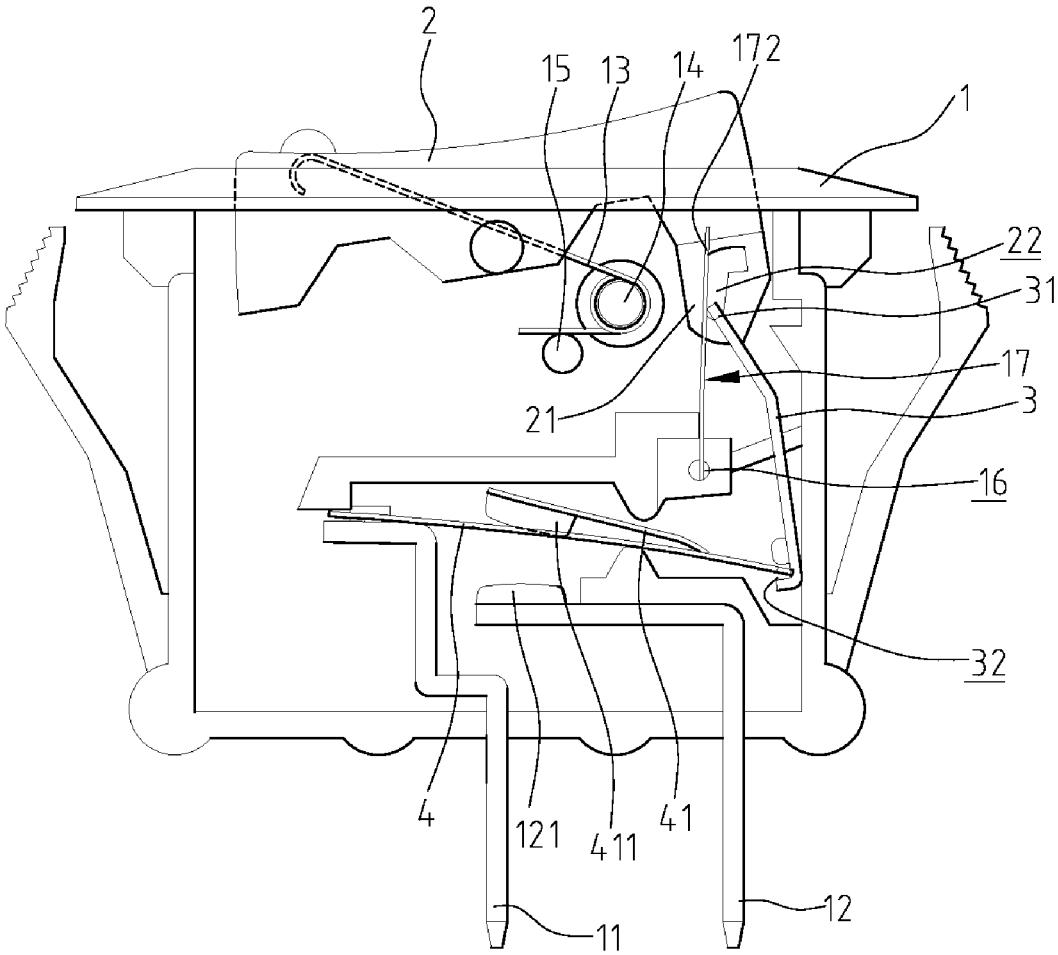
FIG. 5 shows the first end of the operation member moves downward along the vertical space of the slot under the current overload condition.
Figure 6:
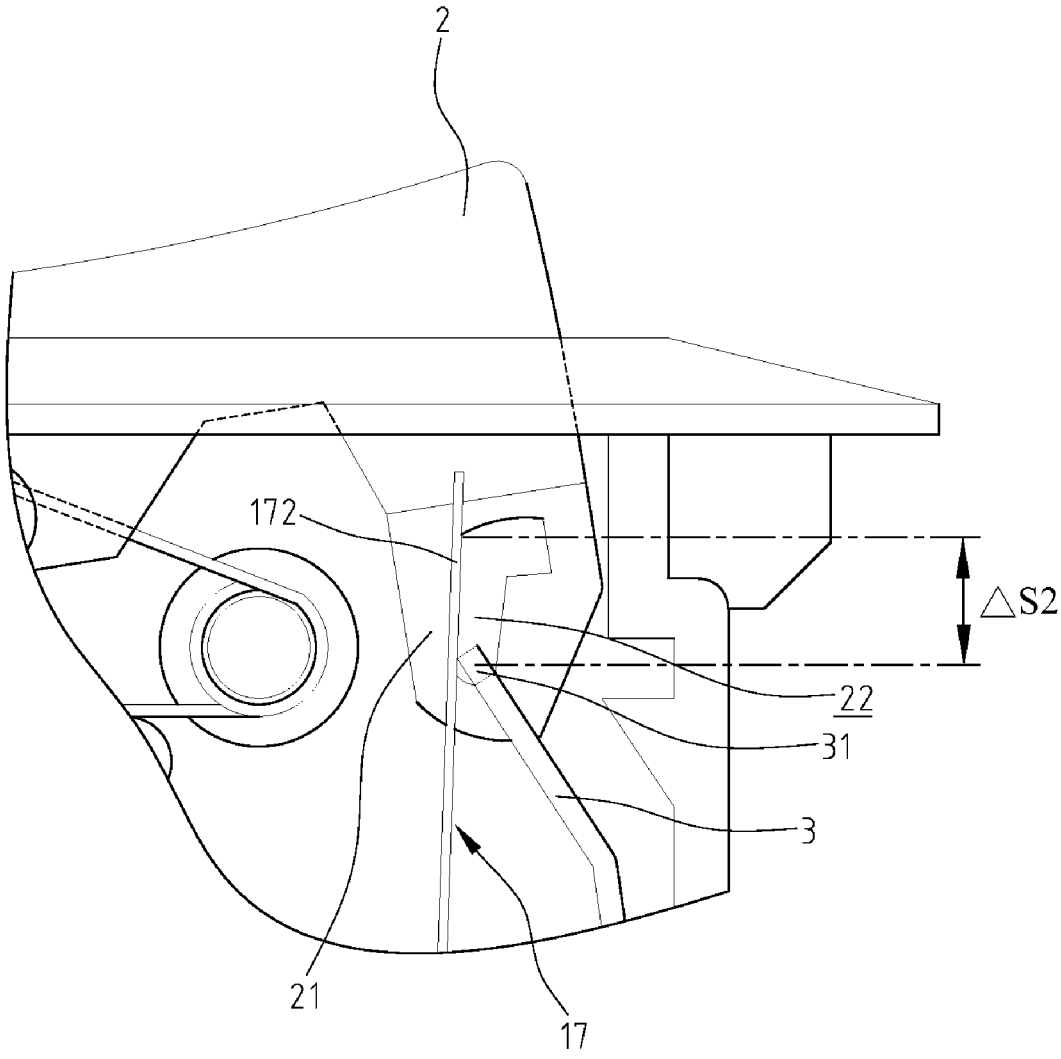
FIG. 6 is an enlarged view to show that a distance ΔS2 is provided for the movement of the first end of the switch member when the switch member is pivoted to the OFF position.

As shown in FIGS. 5 and 6, under the current overload condition, the tongue 41 of the contact plate 4 deforms upward to separate the first contact point 121 and second contact point 411 to cut off the circuit. The first end of the contact plate 4 then is deformed downward to pull the operation member 3 downward, and the horizontal rod 31 of the operation member 3 moves along the vertical space of the slot the distance $\Delta S1$. Therefore, the second end of the switch member 2 is pushed upward by the torsion spring 13, and the first end of the switch member 2 moves downward a distance $\Delta S2$ so that the switch member 2 is pivoted to OFF position as shown in FIG. 2. In the meanwhile, the horizontal rod 31 on the first end of the operation member 3 moves along the vertical space to the right inner end of the horizontal space of the slot 22.

The positioning member 17 ensures that the operation member 3 is not affected by gravity so that the operation member 3 functions normally at any angle. The specific shape of the slot 22 of the extension 21 allows the horizontal rod 31 of the operation member 3 to move in vertical direction along the vertical space of the slot 22 so that the contact plate 4 can be completely deformed and the switch member 2 can be pivoted to OFF position under the current overload condition.

While we have shown and described the embodiment in accordance with the present invention, it should be clear to those skilled in the art that further embodiments may be made without departing from the scope of the present invention.

What is claimed is:

1. A switch, comprising:

a body with a top opening and a switch member pivotally engaged with the top opening of the body, an extension extending from an underside of a first end of the switch member and a slot defined through the extension, a first terminal and a second terminal extending through a bottom of the body, a first contact point connected to the second terminal;

a positioning member having a first end pivotally connected to an inside of the body;

an operation member having a first end movably engaged with the slot of the extension and a second end of the positioning member biasing the first end of the operation member toward the first end of the switch member; and a contact plate being a flexible metal plate and having a first end thereof connected to a second end of the operation member and a second end of the contact plate fixed to the first terminal, an opening defined through the contact plate and a tongue having a first end connected to an inside of the opening, a second end of the tongue being a free end and having a second contact point which is removably in contact with the first contact point on the second terminal, the second end of the contact plate and the second end of the tongue being deformed in opposite direction under the current overload condition.

2. The switch as claimed in claim 1, wherein the slot in the extension is substantially an inverted L-shaped slot and the first end of the operation member includes a horizontal rod which is movably engaged with the slot.

3. The switch as claimed in claim 1, wherein the positioning member is a substantially L-shaped member which includes a horizontal portion at the first end of the positioning member and a vertical portion connected to an end of the horizontal portion, a hook is defined in a distal end of the horizontal portion which extends through a through hole in the body and the hook is hooked with the through hole.

4. The switch as claimed in claim 1, wherein a torsion spring is connected to the inside of the body and includes a coil portion and two legs extended from the coil portion, the coil portion is mounted to a first rod extending from the inside of the body and one of the two legs is biased against a second rod extending from the inside of the body, the other one of the two legs contacts the underside of a second end of the switch member.

5. The switch as claimed in claim 1, wherein a hole is defined through the operation member and a stub extends from an inside of the hole, a lip extends transversely from the second end of the operation member, an engaging space is defined between the stub and the lip, the first end of the contact plate is engaged with the engaging space so that the first end of the contact plate is moved with a movement of the operation member.

6. The switch as claimed in claim 1, wherein the contact plate is a bi-metallic plate.

* * * * *